United States Patent [19]

Weikel, Jr. et al.

[11] 4,219,270

[45] Aug. 26, 1980

[54] REPRODUCING APPARATUS

[75] Inventors: Donald J. Weikel, Jr.; John S. Bernhard, both of Rochester, N.Y.

[73] Assignee: Xerox Corporation, Stamford, Conn.

[21] Appl. No.: 70,597

[22] Filed: Aug. 29, 1979

[51] Int. Cl.[3] ..... G03G 15/00

[52] U.S. Cl. ..... 355/3 R; 355/35 H; 355/15

[58] Field of Search ..... 355/3 R, 35 H, 15, 3 TR; 271/DIG. 2, 307

[56] References Cited

U.S. PATENT DOCUMENTS

| | | | |
|---|---|---|---|
| 3,620,615 | 11/1971 | Volkers | 355/3 R |
| 3,791,729 | 2/1974 | Steiner | 355/3 R |
| 3,804,401 | 4/1974 | Stange | 271/DIG. 2 |
| 3,837,640 | 9/1974 | Norton et al. | 271/DIG. 2 |
| 3,891,206 | 6/1975 | Bar-On | 271/DIG. 2 |
| 3,965,332 | 6/1976 | Thettu | 219/216 |
| 3,992,000 | 11/1976 | Martin | 271/DIG. 2 |
| 4,032,228 | 6/1977 | Whited | 355/15 |
| 4,073,585 | 2/1978 | Kobayashi et al. | 271/DIG. 2 |

*Primary Examiner*—R. L. Moses

[57] ABSTRACT

A reproducing apparatus including an image support surface such as a rotatable drum upon which an image may be formed and subsequently transferred to a transfer member such as paper is provided with a cleaner housing including a restrictor guide means positioned such that any transfer member remaining tacked to the image support surface as the image support surface enters the cleaner housing will be intercepted before it completely enters the cleaner housing. Preferably the restrictor guide means is used in conjunction with a blade cleaner for cleaning the image support surface and the blade cleaner and restrictor guide means together with the image support surface form a cavity within which a tacked transfer member is intercepted such that the trailing portion does not enter the cavity. With this apparatus fouling of the cleaner housing and unscheduled maintenance may be avoided.

10 Claims, 5 Drawing Figures

REPRODUCING APPARATUS

CROSS REFERENCE TO RELATED APPLICATIONS

Reference is made to copending application of Rodney J. Jendrick filed concurrently herewith entitled Sheet Feeding Apparatus and identified by attorney's docket D/78240; and to copending application of William E. Kramer and Frank P. Malinowski filed concurrently herewith entitled Sheet Alignment and Feeding Apparatus and identified by attorney's docket D/78241.

BACKGROUND OF THE INVENTION

This invention relates to reproducing apparatus and in particular to the cleaning station of an automatic reproducing apparatus.

In automatic reproduction apparatus an image formed on an image support surface such as a xerographic drum may be transferred to a first sheet of support material such as paper. Following the transfer of the image, the xerographic image support surface is cleaned for the next image producing cycle. To transfer the image to the first support member, the support members are separately fed from a supply to the transfer station. It sometimes happens with some paper feeders, that double sheet feeding of paper to the transfer station may occur. When this does happen it also frequently happens that following transfer of the image to the paper, the outside sheet of paper is stripped from the image support surface while the inside sheet of paper remains tacked to the image support surface. In that situation the outside sheet of paper continues on normally within the automatic reproducing apparatus through the image fixing station and other processing stations into the output station. In the process this stripped sheet of paper satisfies all the paper jam detection logic of the machine and the machine continues to run without automatically shutting down. While the stripped sheet is passing automatically from the reproducing apparatus, the second sheet remaining tacked to the image support surface enters the cleaner housing and frequently disappears within the housing. Eventually the paper within the cleaner housing will foul the operation of the cleaner housing requiring that machine operation be discontinued and giving rise to removal of the paper and possible major service adjustment from a skilled technician.

In addition, it sometimes happens that even with a single sheet feed of paper from the paper supply to the transfer station, the sheet will remain tacked to the image support surface. If in this instance the jam detection devices or the logic system fails to respond in time the paper will enter the cleaner housing and the same difficulty will be encountered.

PRIOR ART STATEMENT

To minimize some of these difficulties, automatic reproducing apparatus have frequently contained various types of devices or used various techniques for stripping sheets tacked to the image support surface. For example, simple stripper fingers have been suggested in U.S. Pat. Nos. 3,992,000 and 3,965,332 for mechanically stripping a sheet tacked to an image support surface. These devices while somewhat successful frequently result in deterioration of the image support surface over time due to the constant scraping action between the image support surface and the stripper fingers. The use of air cushion supported stripper fingers is suggested in U.S. Pat. Nos. 3,804,401; 3,837,640 and 3,891,206. An electrically biased roller slightly spaced from the copy sheet is suggested by U.S. Pat. No. 3,620,615 and U.S. Pat. No. 3,655,756 describes a manifold having a linear array of spaced discharge orfices which in conjunction with a recess on a circumferential edge of the drum acts to lift and start to peel the copy sheet from the drum.

Alternatively a device for detecting the continued presence of a transfer member after it should have been stripped from the image support surface is proposed in U.S. Pat. No. 3,791,729. It has also been proposed in U.S. Pat. No. 4,032,228 to provide a means for detecting the presence of a sheet within the cleaner housing, the sheet having been transported to the cleaner housing by being tacked to the image support surface.

SUMMARY OF THE INVENTION

In accordance with this invention, a reproducing apparatus having an improved cleaner housing is provided. This improved cleaner housng contains a restrictor guide means to minimize the possibility of operationally fouling the machine by preventing the feeding of transfer members tacked to an image support surface completely into the cleaner housing.

More particularly, the present invention is directed to reproducing apparatus comprising an image support surface, means for moving the image support surface about a closed path, means for forming a developed image on the image support surface, means for transferring the developed image from the support surface to a transfer member, means for cleaning the image support surface including a cleaner housing containing a restrictor guide means positioned within the cleaner housing such that any transfer member present on the image support surface as it moves into the cleaner housing will not completely enter the cleaner housing.

The present invention also provides within the cleaner housing a single mounting from which both a cleaning blade and the restrictor guide means can be mounted such that the cavity defined by them together with the imaging surface is such that there is insufficient room for the trailing portion of a transfer member to enter the cavity.

Accordingly, it is an object of the present invention to provide a novel reproducing apparatus. It is an additional object of the invention to provide a novel cleaning apparatus for a reproducing apparatus.

It is a further object of the invention to provide reproducing apparatus requiring less non-routine maintenance and adjustment by a skilled technician.

It is a further object of the invention to provide means for mechanically containing a tacked sheet of a transfer member when it enters the cleaner housing so that it does not foul the cleaner assembly and require non-routine maintenance.

It is a further object of the invention to provide a device for detecting and stripping a transfer member tacked to the image support surface without mechanically contacting or scraping the image support surface.

It is an additional object of the invention to provide a means for preventing a tacked transfer member from completely disappearing within the cleaner housing and thereby fouling the machine.

It is an additional object to provide a simple and economical means for detecting a transfer member which has not been stripped from the image support surface.

For a better understanding of the invention as well as other objects and further features thereof reference is had to the following drawings and description.

DESCRIPTION OF PREFERRED EMBODIMENT

The invention will now be described by reference to a preferred embodiment of the reproducing apparatus.

Figure 1:
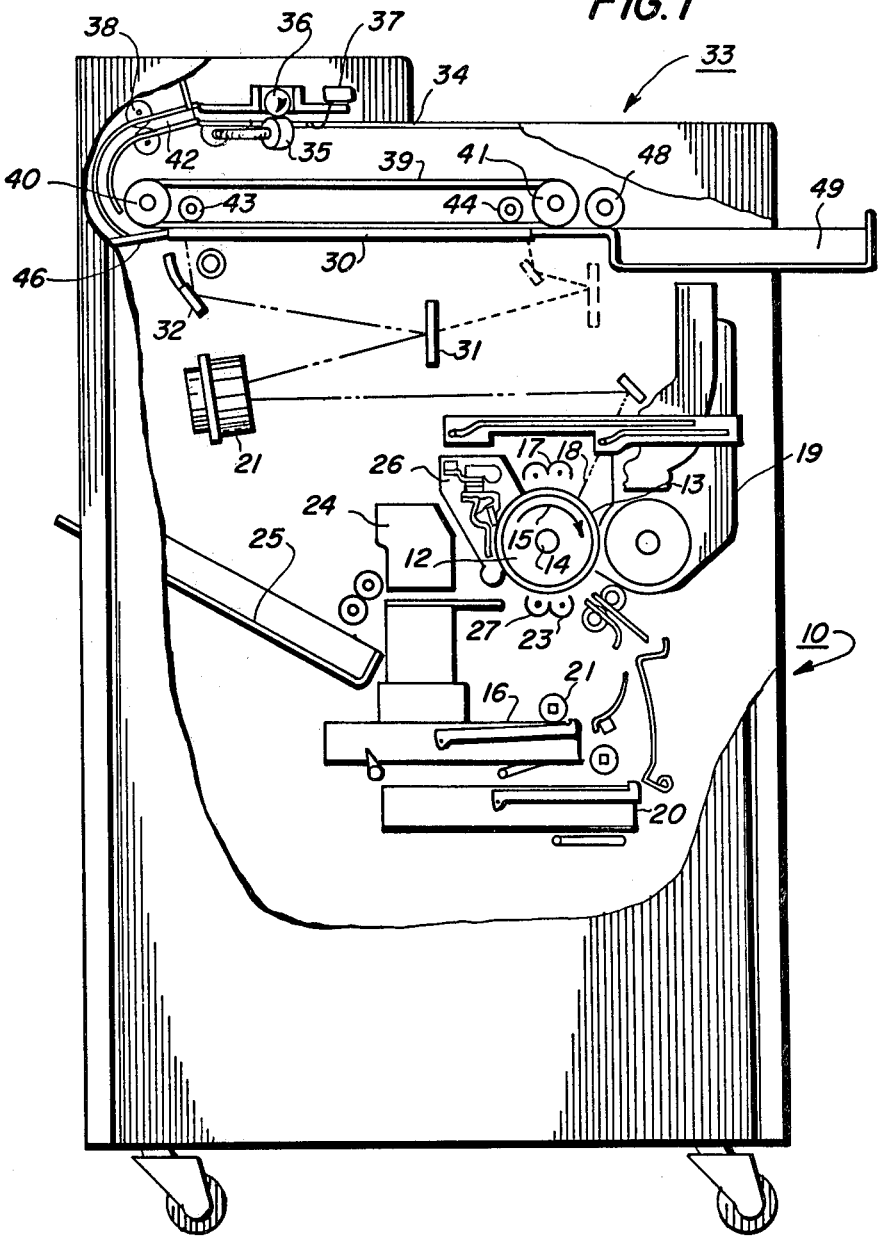
FIG. 1 is a schematic representation of an automatic xerographic reproducing apparatus of the present invention.

Referring now to FIG. 1 there is shown by way of example an automatic xerographic reproducing machine 10 which includes the cleaning station with the restrictor guide means of the present invention. The reproducing machine 10 depicted in FIG. 1 illustrates the various components utilized therein for producing copies from an original document. Although the apparatus of the present invention is particularly well adapted for use in an automatic xerographic reproducing machine 10, it should become evident from the following description that it is equally well suited for use in a wide variety of processing systems including other electrostatographic systems and it is not necessarily limited in the application to the particular embodiment or embodiments shown herein.

The reproducing machine 10, illustrated in FIG. 1 employs an image recording drum-like member 12, the outer periphery of which is coated with a suitable photoconductive material 13. The drum 12 is suitably journaled for rotation within a machine frame (not shown) by means of shaft 14 and rotates in the direction indicated by arrow 15 to bring the image-bearing surface 13 thereon past a plurality of xerographic processing stations. Suitable drive means (not shown) are provided to power and coordinate the motion of the various cooperating machine components whereby a faithful reproduction of the original input scene information is recorded upon a sheet of final support material 16 such as paper or the like.

The practice of xerography is well known in the art and is the subject of numerous patents and texts including *Electrophotography* by Schaffert, and *Xerography and Related Processes* by Dessauer and Clark, both published in 1965 by the Focal Press.

Initially, the drum 12 moves the photoconductive surface 13 through a charging station 17 where an electrostatic charge is placed uniformly over the photoconductive surface 13 in known manner preparatory to imaging. Thereafter, the drum 12 is rotated to exposure station 18 wherein the charged photoconductive surface 13 is exposed to a light image of the original input scene information whereby the charge is selectively dissipated in the light exposed regions to record the original input scene in the form of an electrostatic latent image. After exposure drum 12 rotates the electrostatic latent image recorded on the photoconductive surface 13 to development station 19 wherein a conventional developer mix is applied to the photoconductive surface 13 of the drum 12 rendering the latent image visible. Typically a suitable development station could include a magnetic brush development system utilizing a magnetizable developer mix having coarse ferromagnetic carrier granules and toner colorant particles.

Sheets 16 of the final support material are supported in a stack arrangement on an elevating stack support tray 20. With the stack at its elevated position a sheet separator 21 feeds individual sheets therefrom to the registration system 22. The sheet is then forwarded to the transfer station 23 in proper registration with the image on the drum. The developed image on the photoconductive surface 13 is brought into contact with the sheet 16 of final support material within the transfer station 23 and the toner image is transferred from the photoconductive surface 13 to the contacting side of the final support sheet 16. Following transfer of the image the final support material which may be paper, plastic, etc., as desired is transported through detack station where detack corotron 27 uniformly charges the support material to separate it from the drum 12.

After the toner image has been transferred to the sheet of final support material 16 the sheet with the image thereon is advanced to a suitable fuser 24 which coalesces the transferred powder image thereto. After the fusing process the sheet 16 is advanced to a suitable output device such as tray 25.

Although a preponderance of toner powder is transferred to the final support material 16, invariably some residual toner remains on the photoconductive surface 13 after the transfer of the toner powder image to the final support material. The residual toner particles remaining on the photoconductive surface 13 after the transfer operation are removed from the drum 12 as it moves through a cleaning station 26. The toner particles may be mechanically cleaned from the photoconductive surface 13 by any conventional means as, for example, by the use of a cleaning blade.

Normally, when the copier is operated in a conventional mode, the original document to be reproduced is placed image side down upon a horizontal transparent viewing platen 30 and the stationary original then scanned by means of a moving optical system. The scanning system fundamentally consists of a stationary lens system 21 positioned below the right hand margin of the platen as viewed in FIG. 1 and a pair of cooperating movable scanning mirrors 31, 32 which are carried upon carriages not illustrated. For further description and greater details concerning this type of optical scanning system reference is had to U.S. Pat. No. 3,832,057 to Shogren.

The illustrated apparatus is also provided with a document handler 33 which includes an input station a copying sheet receiving slot 34, registration assist roll 35, idler roll 36 and switch 37. When a sheet is inserted it makes switch 37 which activates registration assist roll 35 which feeds the sheet forward and aligns it against the rear edge guide of the document handler. The pinch rolls 38 are activated to feed a document around the 180° curved guides onto the platen 30. The platen belt transport is comprised of a single wide belt 39 having one run over the platen 30. The belt 39 is wrapped about two pulleys 40 and 41 which are arranged such that the belt surface at the bottom of the pulley with the assistance of input backup roll 43 and output backup roll 44 is in light contact with the platen. The document is driven by the belt 39 across the platen until the trailing edge of the document has cleared registration edge 46 after which the platen belt transport is stopped and the direction in which the document is driven is reversed so that it is registered against registration edge 46 and is now ready for copying. Once in position, the scanning optical system is activated and the document is scanned by full rate mirror 32. At the end of scan the full rate mirror 32 and the half rate mirror 31 are in the positions shown in phantom in FIG. 1. After copying the platen belt transport is again activated and the document is driven off the platen by the output pinch roll 48 into the document catch tray 49.

It is believed that the foregoing general description is sufficient for purposes of the present application to illustrate the general operation of an automatic xerographic copier 10 which can embody the apparatus in accordance with the present invention.

Figure 2:
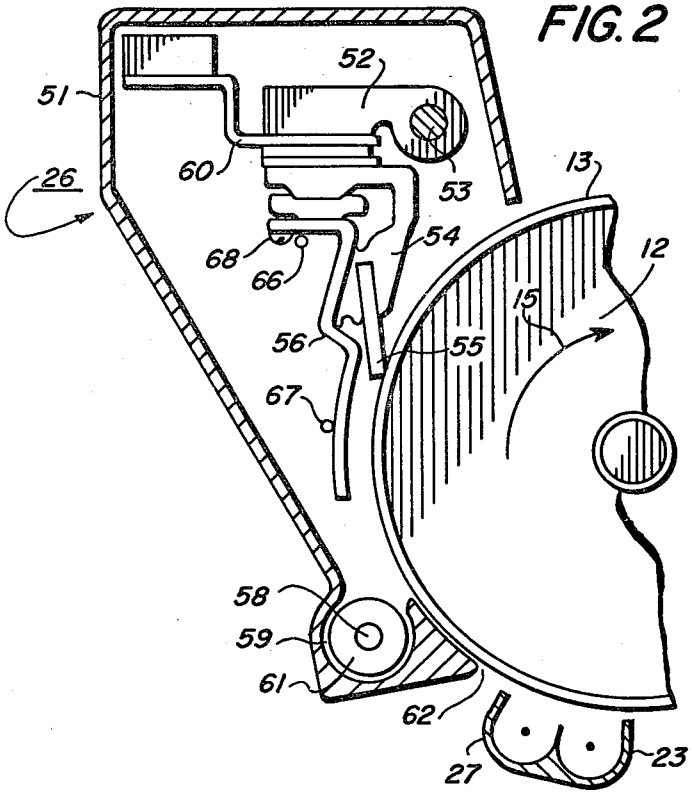
FIG. 2 is an enlarged schematic of a portion of the reproducing apparatus showing in greater detail the cleaning station of the present invention.

Referring more particularly to FIG. 2 wherein the cleaning station 26 is illustrated in greater detail. After development of the electrostatic latent image at developing station 19, the xerographic drum rotates further clockwise to transfer station wherein the developed image is transferred to the copy sheet by means of transfer corotron 23. Thereafter the tacked transfer sheet is electrostatically detacked from the drum by means of detack corotron 27. Subsequently the drum rotates so the imaging surface may be cleaned for the next imaging cycle. The cleaning station 26 comprises a cleaner housing 51 which contains the entire cleaning assembly as well as the restrictor guide member 56 of the present invention. Within the housing 51, the restrictor guide member 56 and the cleaning blade 55 are mounted on the same mounting 52 which is suitably attached to the machine frame. The blade 55 and restrictor mounting 52 pivot about axis 53 to force the blade in contact with the drum. In addition, a counterweight 60 may be added to the mounting to increase the blade force on the drum. The cleaning blade 55 is mounted in the blade holder portion 54 of the mounting 52 and extends longitudinally the width of the imaging surface on the drum.

The restrictor guide means 56 may also be mounted on the mounting 52. The upper portion of the restrictor guide means may be shaped to roughly conform to the shape of the blade 55 and blade holder portion 54 as shown in FIG. 2. The lower portion of the restrictor guide member is closely spaced from the drum surface and generally arcuately conforms to the drum surface. At the bottom of the cleaner housing is the cleaning entry opening 62 which is closely spaced from the surface of the rotating drum. Also at the bottom of the cleaner housing is an auger cavity 59 within which auger 61 is driven about axis 58. As toner is cleaned from the drum it falls to the bottom of the cleaner housing where the auger transports it to a storage compartment (not shown).

In operation, when a sheet of paper remains tacked to the drum, it enters the cleaner housing, its forward motion is interrupted or intercepted by the cleaning blade causing about the leading half of the paper to fold back on itself in accordian fashion within the cavity formed by the restrictor guide member, the cleaning blade, the drum and the entry opening. The trailing portion of the sheet, also about one half, is eventually detached from the drum by the halt of the leading edge of the sheet and it remains outside the cleaner housing. In this position it interrupts the feed of a subsequent sheet of paper thereby causing a paper jam by obscuring the paper path causing the next sheet not to reach a particular destination within a set time or not to make a particular switch. The machine logic particularly the jam detection is then unsatisfied, the machine is shut down and the operator can manually remove the sheet from the cleaner housing merely by pulling the sheet out. The manual removal of the tacked sheet is facilitated by the paper being crumpled in accordian fashion and contained within the cavity formed by the restrictor guide member, the cleaning blade, the drum and the entry opening. Without the restrictor guide member, the space within which the tacked paper could travel is very large which could enable the entire sheet of paper to be completely fed into the cleaner housing while being tacked to the drum. However, according to the present invention this difficulty may be readily corrected by the casual operator without resorting to shutting the machine down and waiting for a skilled technician to possibly remove the cleaner housing. This result is achieved because the restrictor guide prevents the trail edge of the tacked paper from entering the cleaner housing and enables the casual operator to visually see the trailing edge of the jammed sheet and clear it from the machine. This minimizes machine shut down because a tacked sheet which disappears within the cleaner housing eventually causes a cleaning failure leading to machine shut down.

Figure 5:
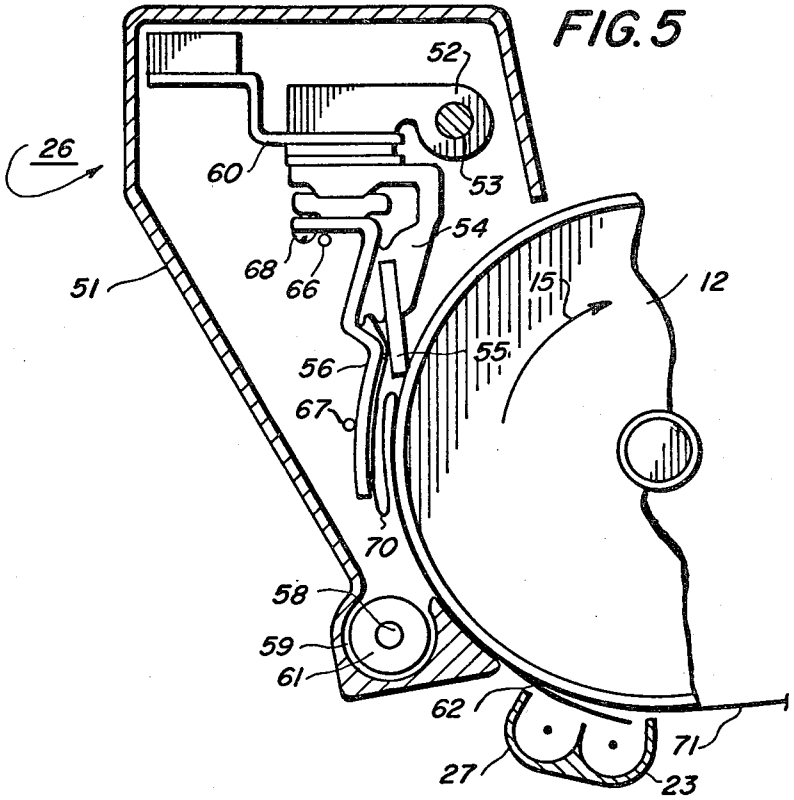
FIG. 5 is a schematic view of the cleaning station depicting the operation of the present invention.

This operation is more vividly depicted in FIG. 5 wherein the forward motion of a first sheet of paper 70 which is tacked to drum 12 is intercepted or halted when it contacts cleaning blade 55. While the drum continues to rotate clockwise and the first sheet of paper 70 remains tacked to it, the paper starts to fold in accordian fashion since it is physically confined within the cavity formed from the drum 12, cleaning blade 55, cleaning entry opening 62 and restrictor guide means 56. After the formation of several accordian folds in sheet 70, the paper no longer remains tacked to the drum 12 but rather the trailing portion hangs down into the path of a subsequent fed sheet 71 whose movement is then interrupted resulting in a paper jam. As may be seen the jam is readily cleared by manually removing sheet 71 and pulling sheet 70 out of the cleaner housing.

The restrictor guide means of the present invention may take any suitable shape. It may, for example, comprise one or more rigid fingers which are closely spaced to the drum. Alternatively it could be a solid sheet of plastic or metal. While both of these configurations are satisfactory, a wireform shape is preferred. This is because the other configurations suffer the deficiency with regard to cleanliness in that with the single finger configuration any copy sheet trapped tends to bow around the finger contacting the interior wall of the cleaner housing upon which a solid layer of toner has accumulated and dislodges the toner so that it falls out of the cleaner housing. In addition with a solid restrictor finger a solid layer of toner is accumulated which is retained on the finger only to be dislodged by a tacked sheet with the toner eventually falling out of the cleaner housing. The toner falls out of the cleaner housing when an operator reaches into the cleaner housing to pull the trailing edge of a tacked sheet and the collected toner is dislodged falling out of the cleaner entry opening thereby contaminating the machine. With the use of a wireform configuration the toner can readily fall down to the auger 61 in the cavity 59 and the tacked sheet trapped by the restrictor guide is confined to the space adjacent the drum and therefore does not collect subsequently cleaned toner. Further since little if any toner accumulates on the wireform, little if any will be dislodged when a tacked sheet is removed.

Figure 3:
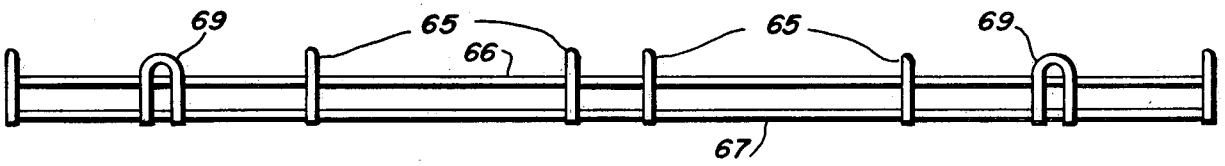
FIG. 3 is a top view of a preferred restrictor guide means of the present invention.
Figure 4:
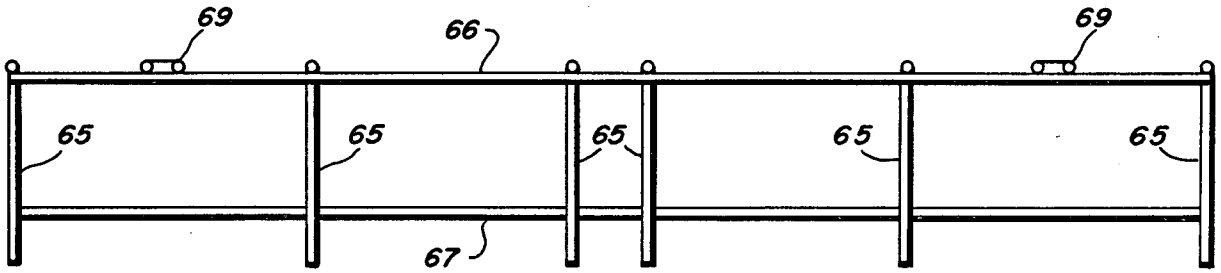
FIG. 4 is an end view of a preferred restrictor guide means of the present invention.

A particularly preferred configuration for a wireform restrictor guide member is illustrated in FIGS. 3 and 4. In conjunction with FIG. 2, it may be seen that the wireform comprises six vertical baffle legs 65 each leg comprising an upper and lower portion, the upper portion spaced from the drum and the lower portion spaced close to and arcuately conforming to the shape of the drum. The six baffle legs 65 are held together with top baffle stiffener 66 and lower baffle stiffener 67. As shown in FIGS. 2 and 3 the wireform baffle is fastened to the mounting 52 by means of screws 68 through loops 69. This design provides a structurally rigid restrictor guide member.

The baffle is mounted to be spaced close to the drum surface so that any sheet of paper remaining tacked to the drum is confined to the cavity formed by the baffle, the cleaning blade, the drum and the entry opening. Typically the spacing is selected so that when a sheet remains tacked to the drum and enters the entry opening it remains tacked until it is stripped off or stopped by the cleaning blade. As the drum continues to rotate the tacked paper will fold in accordian like fashion in the restricted cavity. With a small spacing, the accordian like folds will be very small and a substantial portion of the trailing edge of the paper will remain outside the cleaner housing enabling an operator to manually pull it out and remove it. In achieving this result the spacing of the wireform from the drum will typically be of the order of from about 0.05 inch to about 0.02 inch. As may be readily observed from FIG. 2 with the small cavity defined by the restrictor guide member, cleaning blade, drum and the entry opening only about one half of the length of the paper enters the cleaner housing. This readily enables one to grasp the trailing edge of the sheet and manually withdraw the sheet. On the other hand without the restrictor guide member, the size of the cavity in the cleaner housing is such that the paper sheet would readily be swallowed up within the cavity.

To enhance the cleaning efficiency of the cleaning blade and to reduce localized wear on the blade cutting edge as well as substiantially eliminating entrapment of foreign matter between the blade and the drum surface, the cleaning blade may be periodically stepped in predetermined increments back and forth across the drum surface over a path of travel substantially normal to the direction of motion of the drum. For further details of such a translating apparatus, attention is directed to U.S. Pat. No. 3,838,472. Since the restrictor guide means of the present invention is mounted together with a cleaning blade on the same mounting it may be also translated as the cleaning blade is translated.

The cleaning blade may be comprised of any suitable material. Typically flexible materials relatively soft to prevent or minimize surface abrasion or scratching are selected. The material should however posses sufficient strength and resiliency to allow for effective cleaning. Typically elastomeric materials such as polyurethane are suitable.

The patents and texts referred to specifially in this application are intended to be incorporated by reference into the body of this application.

In accordance with the invention a reproducing apparatus with a improved cleaner housing containing a restrictor guide means is provided. This enables the early detection of a copy sheet tacked to the drum and its simple removal. While this invention has been described with reference to the specific embodiments described, it will be apparent to those skilled in the art that many alternatives, modifications or variations may be made by those skilled in the art. For example, while the invention has been described with reference to a xerographic drum, it should be noted that it is applicable to virtually any machine configuration. It could for example be used in a machine using a belt type image support surface. Accordingly, it is intended to embrace all such alternatives and modifications as may fall within the spirit and scope of the appended claims.

What is claimed is:

1. Reproducing apparatus comprising an image support surface upon which an image may be formed, means for moving the image support surface about a closed path, means for forming a developed image on said image support surface, means for transferring said developed image from said image support surface to a transfer member, means for cleaning said image support surface after said developed image has been transferred to said transfer member, said cleaning means including cleaner housing means, the improvement comprising restrictor guide means positioned within the cleaner housing means such that any transfer member present on the image support surface as it moves into the cleaner housing means will not completely enter the cleaner housing means.

2. The reproducing apparatus of claim 1 wherein said restrictor guide means comprises a guide member spaced close to but from and conforming to the path of the imaging support surface.

3. The reproducing apparatus of claim 2 wherein said guide member comprises at least one finger like portion.

4. The reproducing apparatus of claim 2 wherein said image support surface comprises a rotatable drum and said guide member comprises a wireform member, the leading portion of the wireform member in relation to the rotation of the drum being spaced from and arcuately conforming to the rotatable drum path of travel.

5. The reproducing apparatus of claim 1 wherein said cleaner housing means includes an entry opening adjacent said image support surface, a mounting, a cleaning blade mounted on said mounting and in contact with the image support surface within said cleaner housing.

6. The reproducing apparatus of claim 5 wherein said restrictor guide means is mounted on said mounting adjacent to and behind said cleaning blade and wherein the lower portion of said restrictor guide means generally conforms to the path of the image support surface and terminates adjacent said cleaner housing entry opening.

7. The reproducing apparatus of claim 6 wherein said restrictor guide means is a structurally rigid member.

8. The reproducing apparatus of claim 6 wherein the cavity defined by the cleaning blade, the mounting, the image support surface and the restrictor guide means is such that in operation the leading portion of a sheet tacked to the image support surface will enter the cleaner housing entry opening and be intercepted within said cavity such that the trailing portion does not enter the cavity.

9. The reproducing apparatus of claim 6 wherein the image support surface comprises a rotatable drum and the restrictor guide means comprises a wireform member spaced from and arcuately conforming to the rotatable drum path of travel.

10. The reproducing apparatus of claim 9 wherein said wireform member extends closely spaced from and longitudinally substantially across the rotatable drum surface.

* * * * *